US007824012B2

(12) United States Patent
Kubo

(10) Patent No.: US 7,824,012 B2
(45) Date of Patent: Nov. 2, 2010

(54) INK JET RECORDING HEAD WIRING PATTERN

(75) Inventor: Tomoyuki Kubo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 925 days.

(21) Appl. No.: 11/699,687

(22) Filed: Jan. 29, 2007

(65) Prior Publication Data

US 2008/0030548 A1 Feb. 7, 2008

(30) Foreign Application Priority Data

Jan. 27, 2006 (JP) ..... 2006-018572

(51) Int. Cl.
*B41J 2/14* (2006.01)
*B41J 2/05* (2006.01)
*B41J 2/045* (2006.01)

(52) U.S. Cl. ..... 347/50; 347/58; 347/71

(58) Field of Classification Search ..... 347/50, 347/68, 12, 13, 40, 41, 42, 49, 54, 56, 57, 347/58, 59, 61, 62, 63, 64, 65, 67
See application file for complete search history.

(56) References Cited

U.S. PATENT DOCUMENTS

| | | | | |
|---|---|---|---|---|
| 6,672,715 | B2 | 1/2004 | Isono et al. | |
| 7,055,936 | B2 | 6/2006 | Imai et al. | |
| 7,284,841 | B2 * | 10/2007 | Imai et al. | 347/71 |
| 7,416,279 | B2 * | 8/2008 | Isono | 347/50 |
| 7,517,065 | B2 * | 4/2009 | Isono | 347/71 |
| 7,553,000 | B2 * | 6/2009 | Katayama | 347/50 |
| 7,568,783 | B2 * | 8/2009 | Katayama | 347/42 |
| 7,597,422 | B2 * | 10/2009 | Katayama et al. | 347/50 |
| 2003/0063449 | A1 | 4/2003 | Suzuki et al. | |
| 2005/0168536 | A1 | 8/2005 | Katayama | |
| 2005/0179747 | A1 | 8/2005 | Iamai et al. | |
| 2006/0203040 | A1 | 9/2006 | Imai et al. | |
| 2007/0182787 | A1 * | 8/2007 | Kubo et al. | 347/58 |

FOREIGN PATENT DOCUMENTS

| | | |
|---|---|---|
| JP | 11147311 | 6/1999 |
| JP | 2003-80709 | 3/2003 |
| JP | 2003-159795 | 6/2003 |
| JP | 2004-114609 | 4/2004 |
| JP | 2005-161760 | 6/2005 |
| JP | 2005-238839 | 9/2005 |

* cited by examiner

*Primary Examiner*—Lam S Nguyen
*Assistant Examiner*—Rene Garcia, Jr.
(74) *Attorney, Agent, or Firm*—Frommer Lawrence & Haug LLP

(57) ABSTRACT

An ink jet recording head includes: an actuator including: a plurality of energy generators; and a plurality of terminals arranged in arrays; and a wiring material superimposed on a surface of the actuator, and including a plurality of lands which are arranged in arrays; and a plurality of wiring patterns which are connected to the plurality of lands respectively and are led out in a lead out direction, wherein: lands of the plurality of lands in adjacent arrays are arranged staggered with respect to each other; a distance between at least two adjacent land arrays on a led out side is greater than a distance between adjacent ones of the other arrays of lands; and the wiring pattern has a bend portion, which extended at an angle to the led out direction, at a position between two adjacent discrete lands in the at least two adjacent land arrays.

9 Claims, 6 Drawing Sheets

INK JET RECORDING HEAD WIRING PATTERN

CROSS-REFERENCE TO THE RELATED APPLICATION(S)

This application is based upon and claims priority from prior Japanese Patent Application No. 2006-018572 filed on Jan. 27, 2006, the entire contents of which are incorporated herein by reference.

TECHNICAL FIELD

The present invention relates to an ink jet recording head, and particularly to a connection structure of a wiring material for feeding power to an actuator.

BACKGROUND

In an ink jet recording head, as in JP-A-2003-159795, a plurality of pressure chambers disposed in two arrays is provided in a cavity unit in which a plurality of plates is stacked, and an actuator including energy generators (in JP-A-2003-159795, activators) corresponding to the pressure chambers is bonded to the cavity unit. Then, in order to apply a voltage to the energy generators of the actuator, surface electrodes corresponding to the energy generators are provided, on a top surface of the actuator, along both longitudinal side edges thereof, and bonding terminals of a wiring material and terminals of the actuator are bonded to be superimposed on each other. The wiring material being formed to be long in a longitudinal extension direction of the actuator, a large number of wires connected to two arrays of the bonding terminals in the longitudinal direction are formed in a portion of narrow width (a width in a direction perpendicular to the longitudinal direction) of the wiring material, and extended to an exterior, and the wires from the bonding terminals have a minute width and a narrow distance between them.

In JP-A-11-147311, it is considered that a flexible wiring material (in JP-A-11-147311, a flexible circuit substrate), being configured of a stacked body of a plurality of substrate layers each including wires on one surface, has an opening formed in at least one of the plurality of substrate layers, in which bonding electrodes are formed by exposing via the opening the wires of a substrate layer disposed on a rear side of the at least one substrate layer, and bonded to surface electrodes used as discrete electrodes, thereby realizing a high integration of the wires.

Also, in JP-A-2005-161760, in a configuration of the flexible wiring material (in JP-A-2005-161760, a flexible flat cable), a plurality of discrete bonding electrodes electrically connected independently to a plurality of energy generators which emit an energy for causing an ink ejection to an actuator is staggered and stepped, thereby preventing a distance between the wires from being too small in a place having high wiring density.

SUMMARY

Recently, as demand for performance combined with reduction in size, an increase in speed and an improvement in printing quality has been made on an ink jet printer, the speed has been increased by increasing a number of nozzles in an ink jet recording head to cause a high density, or the printing quality has been improved by reducing a particle diameter of ejected ink. Particularly, with the increase in speed, when the number of nozzles increases, the energy generators and the surface electrodes of the actuator corresponding to the nozzles also increase in number and, in response, bonding electrodes of the flexible wiring material also increase, thus increasing a number of wiring patterns. Particularly, in the kind of configuration shown in JP-A-2005-161760, as the plurality of discrete bonding electrodes formed in the flexible wiring material is wired parallel to a direction in which a drive IC chip furnished with a drive circuit is mounted (a direction in which the flexible wiring material is extended) from each of them, and highly integrated into and connected to the drive IC chip, it is necessary, along with an increase in the number of wiring patterns, to widen a width of the flexible wiring material or make the wires more fine and narrow a distance between the wires. However, in the event that the width of the flexible wiring material is widened, it causes an increase in size and cost while, in the event that the wires are made fine and the distance is narrowed, there is a limitation in manufacturing or a danger that a resistance value becomes high, or it becomes likely to cause a short circuit. Also, it is possible to make the flexible wiring material multilayered to increase the number of wiring patterns, however, it results in a significant increase in cost.

Aspects of the present invention provide an ink jet recording head that enables a high integration without narrowing the distance between the wires, by contriving a wiring structure of flexible wiring material.

According to an aspect of the invention, there is provided an ink jet recording head including: an actuator including: a plurality of energy generators, for ejecting ink; and a plurality of terminals arranged in arrays on a surface of the actuator, for applying a voltage to each of the energy generators; and a wiring material superimposed on the surface of the actuator, and including a plurality of lands which are arranged in arrays corresponding to the plurality of terminals, respectively; and a plurality of wiring patterns which are connected to the plurality of lands respectively and which are led out in a lead out direction parallel to the surface of the actuator and perpendicular to the arrays of the terminals; wherein: the lands are electrically connected to the terminals, respectively; lands of the plurality of lands in adjacent arrays are arranged staggered with respect to each other; a distance between at least two adjacent land arrays, among the arrays of the plurality of lands, on a led out side at which the wiring patterns are led out is greater than a distance between adjacent ones of the other arrays of lands; and the wiring pattern has a bend portion, which extended at an angle to the led out direction, at a position between two adjacent discrete lands in the at least two adjacent land arrays.

DETAILED DESCRIPTION

Hereafter, description will be given of exemplary aspect of the invention with reference to the drawings. In the following description, an ink ejection side will be taken as a bottom surface and a bottom direction, and a side opposite thereto will be taken as a top surface and a top direction. Also, suffixes M, C, B and Y indicate relationships with a magenta ink, a cyan ink, a black ink and a yellow ink.

Figure 1:
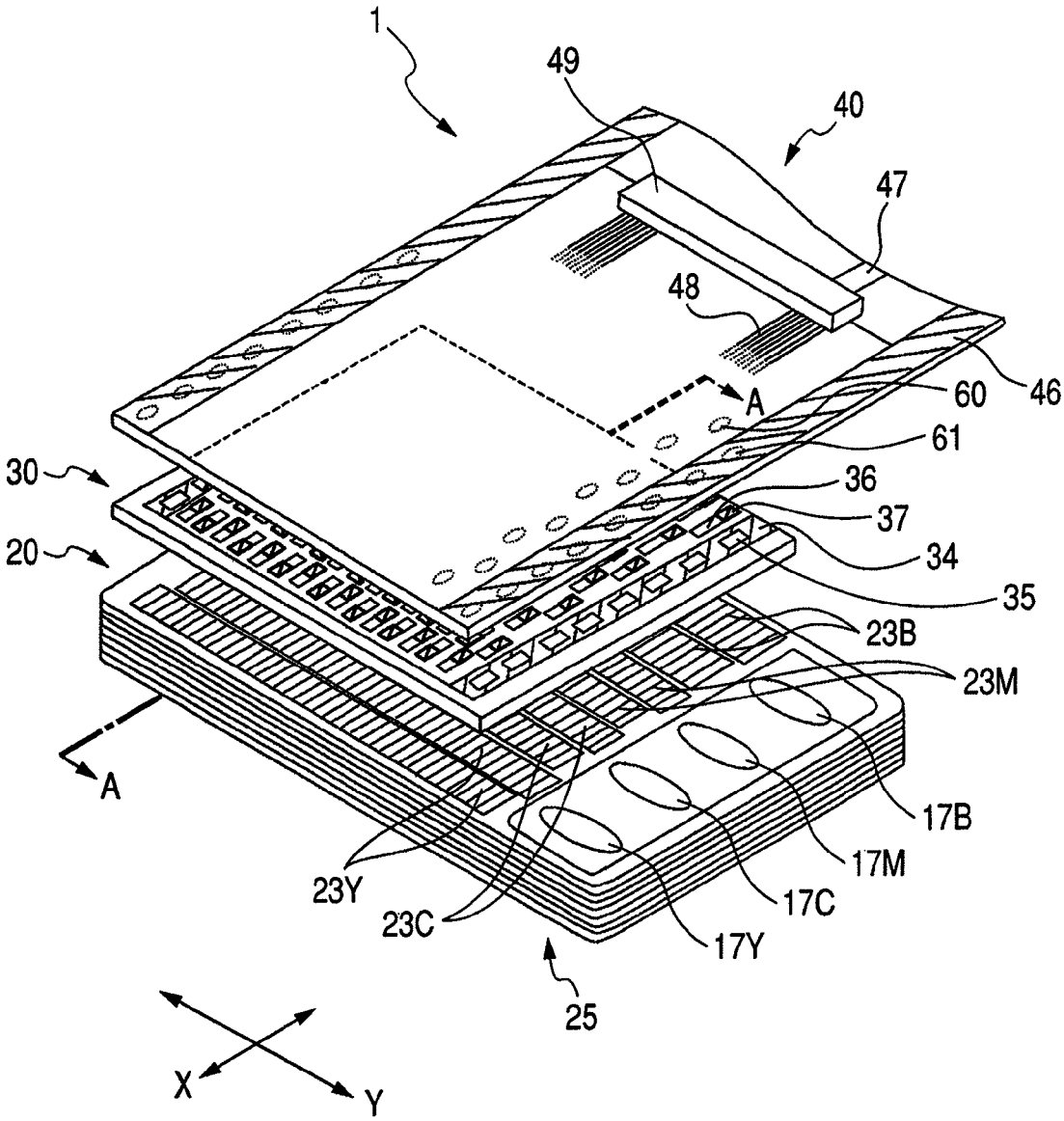
FIG. 1 is a perspective view of a recording head.

In an ink jet printer apparatus, although not shown, a head holder functioning as a carriage is attached to a guide shaft, the head holder being mounted with a recording head 1 which records on a recording paper by ejecting the inks from nozzles 25 formed in a bottom surface of the head holder, and an ink tank in which is contained an ink of each color, for example, black B, cyan C, magenta M and yellow Y, and a printing is carried out by an actuator 30 of the recording head 1 being driven while scanning alternately backward and forward along the recording paper in a width direction thereof (an X direction in FIG. 1).

The recording head 1, as shown in FIG. 1, has a structure in which the plate type actuator 30 which selectively gives an ejection pressure to the inks in a cavity unit 20 is bonded via an adhesive sheet to a top of the cavity unit 20 which has on a bottom surface a nozzle surface with the plurality of nozzles 25 arranged in a Y direction. Furthermore, a flexible wiring material 40, by having one end bonded to the actuator 30, is electrically connected to a top surface of the cavity unit 20, and has the other end extended parallel to a surface of the actuator 30 and in the X direction. A drive IC chip 49 furnished with a drive circuit therein is mounted on the flexible wiring material 40.

Figure 2:
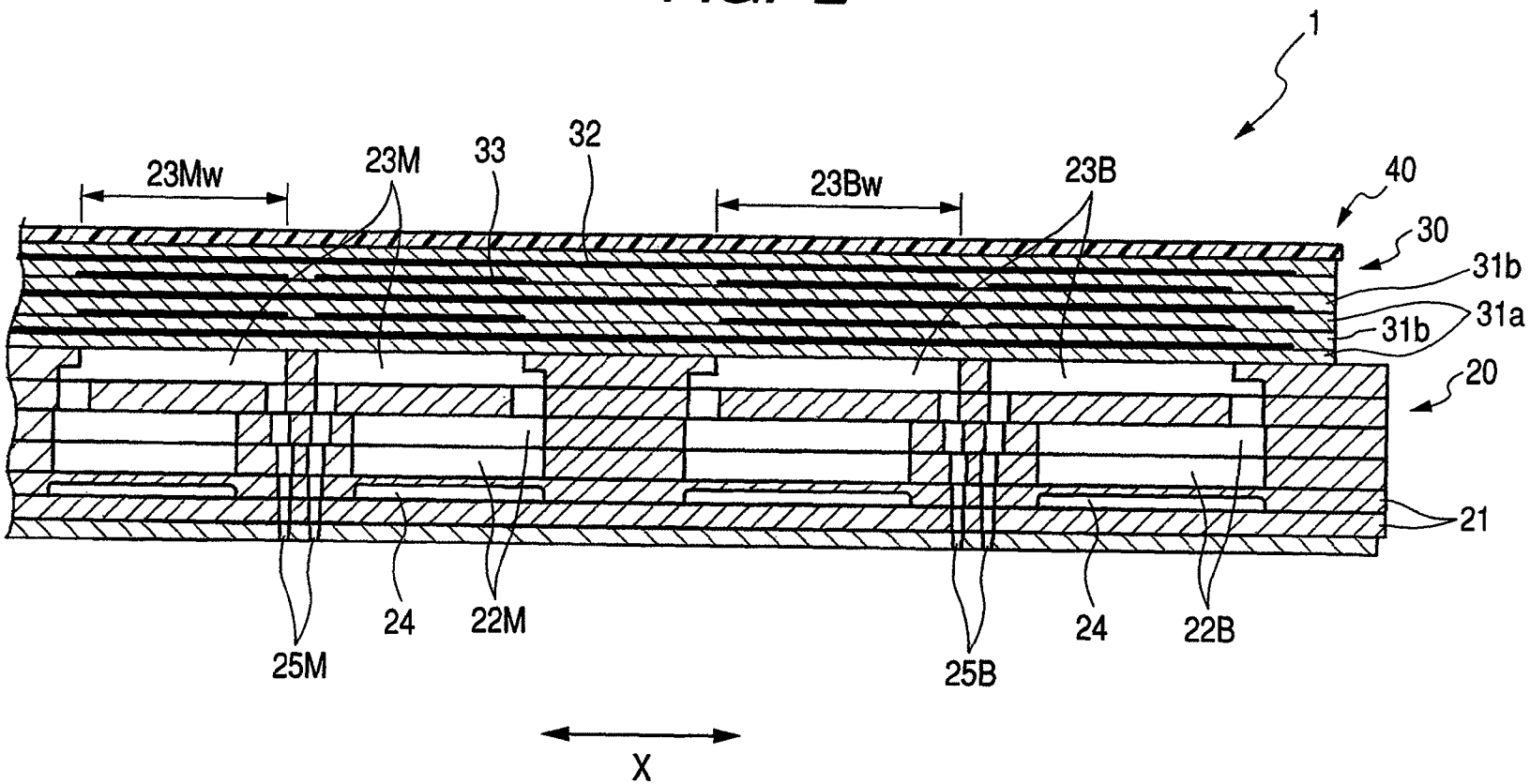
FIG. 2 is a sectional view of the recording head taken along line A-A.

The cavity unit 20 is configured by stacking a plurality of thin plates 21, as in FIG. 2, and bonding them by means of an adhesive in the bottommost plate 21. The plurality of nozzles 25 are arranged staggered in a longitudinal direction of the cavity unit 20 (the Y direction), and provided in a plurality of arrays at appropriate intervals in a direction (the X direction) perpendicular to the longitudinal direction. In this exemplary aspect, the plurality of nozzles 25 are formed at minute intervals, the flexible wiring material 40 is extended, and black ink nozzle arrays 25B and magenta ink nozzle arrays 25M as well as, although not shown, cyan ink nozzle arrays 25C and yellow ink nozzle arrays 25Y are provided (two each) in order from a direction (the X direction, a right direction of FIGS. 1 and 2) in which the drive IC chip 49 is mounted. The plurality of nozzles 25 have a microscopic diameter, with the black ink nozzles 25B having a diameter on the order of 20 μm, while the other ink nozzles 25M, 25C and 25Y have a diameter on the order of 18 μm. The black ink nozzles 25B have a larger diameter than the other color ink nozzles 25M to 25Y, and the black ink is ejected in a larger volume per ink droplet than the color inks.

Also, in the topmost plate 21, a plurality of pressure chambers 23 are formed in an elongated shape in a plan view, being formed to have one end in a longitudinal direction thereof (the X direction) communicated with the plurality of nozzles 25, and the other end communicated with manifold channels 22 to be described hereafter. As in FIG. 1, the plurality of pressure chambers 23 are formed in such a way that pressure chambers 23 in one array are staggered with respect to ones in another adjacent array in the longitudinal direction of the cavity unit 20 (the Y direction), and is arranged in a plurality of arrays in a direction (the X direction) perpendicular thereto. In this exemplary aspect, pressure chambers 23B, 23M, 23C and 23Y are arranged in two arrays for each color, in order, in the X direction corresponding to the plurality of nozzle arrays 25B, 25M, 25C and 25Y. Also, the black ink pressure chambers 23B have a longer longitudinal (X direction) length 23Bw than longitudinal (X direction) lengths 23Mw, 23Cw and 23Yw of the other ink pressure chambers and, as 23Bw is a length on the order of 1.4 mm, and 23Mw to 23Yw are lengths on the order of 1.1 mm. The black ink pressure chambers 23B have a longer longitudinal (X direction) length than the other color ink pressure chambers 23M to 23Y. For this reason, as the black ink undergoes more pressure for ejection than the other color inks, one ink droplet of the black ink has a large ejection energy, and the black ink pressure chambers 23B can eject the ink droplet of the black ink in a larger volume than ink droplets ejected from the other pressure chambers 23M to 23Y. All the pressure chambers 23 are formed to have the same (Y direction) width.

Also, as in FIG. 1, ink supply ports 17B, 17M, 17C and 17Y are disposed by ink color in the top surface of the cavity unit 20, a configuration being such that the inks supplied from the ink tank (not shown) are supplied to the individual ink supply ports 17B to 17Y, and the inks flowing into the manifold channels 22B, 22M, 22C and 22Y (22C and 22Y are not shown) in the cavity unit 20 extending from the respective ink supply ports are distributed by ink color to the plurality of pressure chambers 23B to 23Y via communication holes passing through the plates 21, and reach the corresponding nozzles 25B to 25Y from the individual pressure chambers 23B to 23Y. In this exemplary aspect, the thin plates 21 have a thickness on the order of 50 to 150 μm, the plates 21 having the plurality of nozzles 25 are made of a synthetic resin such as polyimide, and the other plates 21 are made of a 42% nickel alloy steel sheet.

Next, description will be given of the actuator 30. As in FIG. 2, the actuator 30 is configured by stacking a plurality of ceramic layers 31, which includes a bottommost ceramic layer covering each plurality of pressure chambers 23B to 23Y, in a direction perpendicular to an arrangement surface of the plurality of pressure chambers 23 from a side of the pressure chambers of the cavity unit 20. The ceramic layers, each having a thickness on the order of 30 μm, are made of piezoelectric ceramics such as PZT. On each of top surfaces (wide surfaces) of even number ceramic layers 31*b*, among the ceramic layers 31, counting from below, narrow discrete electrodes 33 are formed in places thereof corresponding to the individual pressure chambers 23 in the cavity unit 20, being formed staggered in the Y direction of the cavity unit 20, and arranged in a plurality of arrays in a direction (the X direction) perpendicular to the Y direction. As an X direction length of the discrete electrodes 33 approximately corresponds to the pressure chambers 23B to 23Y, the discrete electrodes 33B corresponding to the black ink pressure chambers 23B are formed to be longer than the X direction length of the discrete electrodes 33M, 33C and 33Y corresponding to the other ink pressure chambers 23M to 23Y. Also, common electrodes 32 common to the plurality of pressure chambers 23, being formed on each of top surfaces (wide surfaces) of odd numbered ceramic layers 31*a* counting from below, are connected to a ground potential. The discrete electrodes 33 and the common electrodes 32 are alternately disposed with at least one ceramic layer 31, excepting the bottommost ceramic layer, sandwiched between them, and face each other. Then, each discrete electrode 33 in the actuator 30 and each pressure chamber 23 in the cavity unit 20 are caused to face each other, and the cavity unit 20 and the actuator 30 are adhesively fixed to each other.

Also, in the actuator 30, with a portion of the ceramic layers 31 between the discrete electrodes 33 and the common electrodes 32, which oppose each other in a stacking direction of the plurality of ceramic layers 31, as an energy generator, by the drive IC chip 49 (to be described hereafter) selectively applying a voltage between the discrete electrodes 33 and the common electrodes 32, the energy generators corresponding to the discrete electrodes 33 to which the voltage has been applied is distorted in the stacking direction. The displacement changes a capacity of the pressure chambers 23, generating a pressure and a pressure wave which cause an ink ejection, and the inks are ejected from the nozzle 25.

The energy generators, being identical in quantity to the pressure chambers 23, are arranged in the array direction (the Y direction) corresponding to identical arrays. Also, the energy generators are formed lengthwise in the X direction in a longitudinal direction of the pressure chambers 23, and adjacent energy generators also being of the same direction as the pressure chambers 23 are arranged staggered, with two arrays being arranged in the X direction for each ink color. As an X direction length of the energy generators corresponds to an X direction length of the pressure chambers 23B to 23Y, energy generators corresponding to the black ink pressure chambers 23B are formed to be longer than energy generators corresponding to the other ink pressure chambers 23M to 23Y. For this reason, compared with the other color inks, it is possible to supply more pressure for ejecting the black ink, enabling an increase in an ejection ink droplet volume of the black ink.

Figure 3:
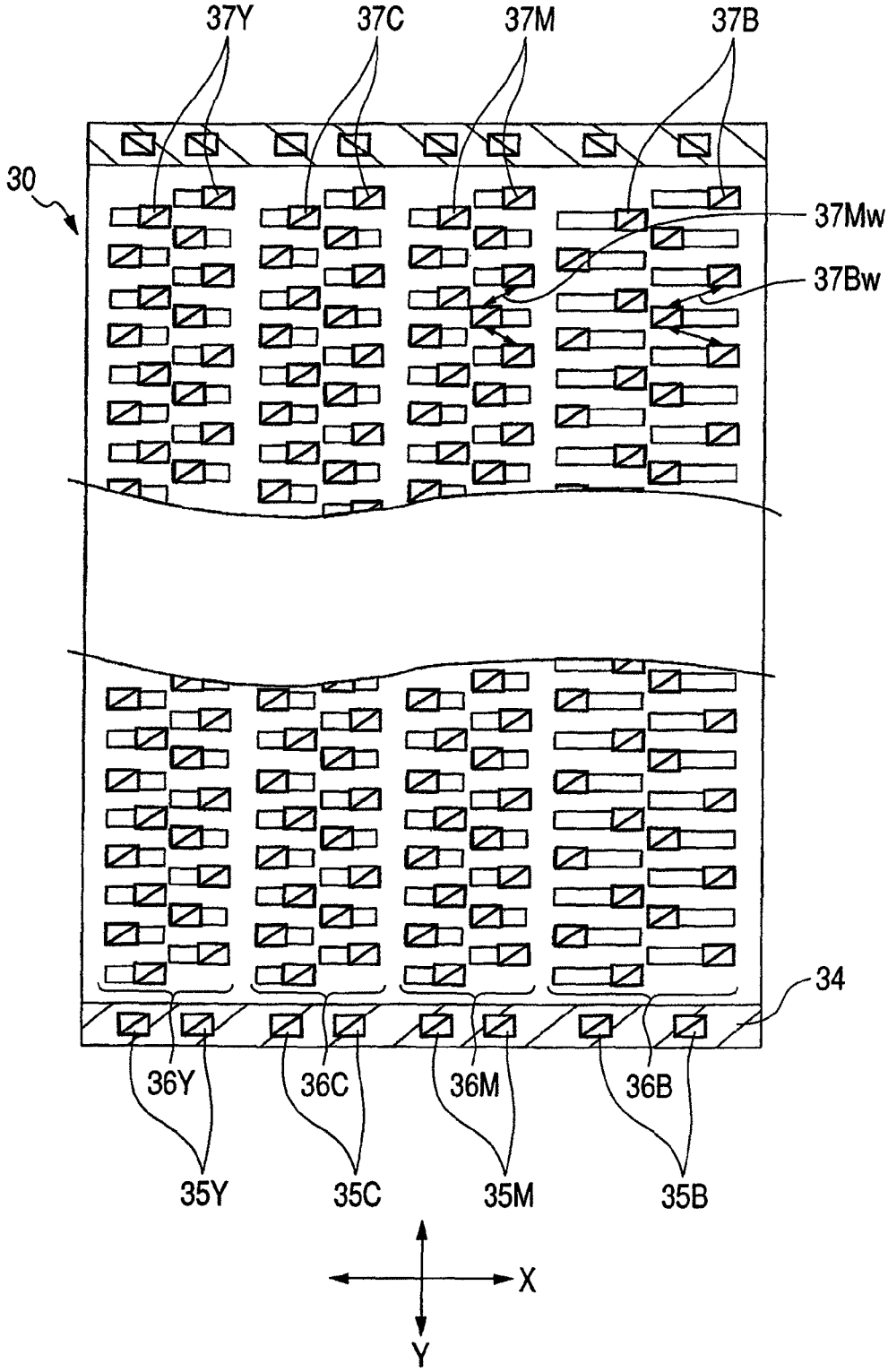
FIG. 3 is a plan view of a topmost surface of an actuator.

Furthermore, as in FIGS. 1 and 3, discrete surface electrodes 36 and common surface electrodes 34 corresponding to the discrete electrodes 33 and the common electrodes 32 are formed on a top surface of a topmost layer of the actuator 30. The individual surface electrodes 36 and 34 are electrically connected to the respective discrete electrodes 33 and common electrodes 32 via a conductive material filling a through hole (not shown) penetrating the stacking direction of the stacked ceramic layers 31. Although the discrete surface electrodes 36 are approximately parallel to the discrete electrodes 33, and have approximately the same narrow rectangular shape, they are shorter than the X direction length of the discrete electrodes 33. Also, as with the nozzle arrays 25B to 25Y (pressure chamber arrays 23B to 23Y), two arrays of the discrete surface electrodes 36 being provided in the X direction for each ink color in the longitudinal direction (the X direction) of the actuator 30, two arrays forming a pair are arranged so as to be staggered (discrete surface electrode arrays 36B to 36Y). As the discrete surface electrode arrays 36B to 36Y correspond to discrete electrode arrays 33B to 33Y, the discrete surface electrode arrays 36B corresponding to the black ink discrete electrodes 33B are formed to be longer than the X direction length of the discrete surface electrodes 36M to 36Y corresponding to the other ink discrete electrode arrays 33M to 33Y. Also, the common surface electrodes 34 are formed in a strip shape along a perimeter of both Y direction outermost ends of the topmost surface of the actuator 30.

"Discrete electrode terminals 37 and common electrode terminals 35 are provided on the discrete surface electrodes 36 and the common surface electrodes 34, respectively, corresponding to discrete electrode lands 60 and common electrode lands 61, to be described hereafter, which are formed on a bonding surface (a bottom surface) of the flexible wiring material 40 bonded to the actuator 30. The discrete electrode terminals 37, having the same narrow rectangular shape as the discrete surface electrodes 36, are arranged alternately, in each array of the discrete surface electrodes 36 (each array in the Y direction in FIG. 3), toward one end or toward the other end in a longitudinal direction (the X direction) of each discrete surface electrode 36. That is, as shown in FIG. 3, in each of the discrete surface electrode arrays 36, the discrete electrode terminals 37 are formed in two adjacent arrays arranged extending in the Y direction, and the discrete electrode terminals 37 in the two adjacent arrays are disposed staggered with respect to each other. As such, while the discrete surface electrode arrays 36B to 36Y are formed arranged in eight arrays in the X direction of the actuator 30 for each ink color, the discrete electrode terminal arrays 37B to 37Y are formed arranged in four arrays in the X direction for each ink color."

For this reason, as in FIG. 3, in two discrete electrode terminal arrays 37 disposed adjacent to each other with respect to each array of the discrete surface electrodes 36 (each array in the Y direction in FIG. 3), a distance between discrete electrode terminals 37 adjacent to each other corresponds to the longitudinal (X direction) length of the discrete surface electrodes 36. As such, as described heretofore, a distance 37Bw between the discrete electrode terminals 37 adjacent to each other in the Y direction in the discrete electrode terminal arrays 37B formed on each array of the black ink discrete surface electrodes 36B is greater than a distance (37Mw, 37Cw, 37Yw) between the discrete electrode terminals adjacent to each other in the Y direction in the other ink discrete electrode terminal arrays 37M to 37Y. Also, the common electrode terminals 35, having the same narrow rectangular shape as the discrete electrode terminals 37, are arranged (two for each ink color) in the X direction along a top of the strip-like common surface electrodes 34 (34B to 34Y). The discrete surface electrodes 36 and the common surface electrodes 34 are formed by screen printing a silver-palladium conductive member, and the discrete electrode terminals 37 and the common electrode terminals 35 are formed by printing silver on the discrete surface electrodes 36 and the common surface electrodes 34.

Next, a description will be given of the flexible wiring material 40 as an example of a wiring substrate for electrically bonding to the plurality of discrete electrode terminals 37 and the common electrode terminals 35. As in FIG. 1, the flexible wiring material 40, on which are disposed a plurality of wiring patterns 47 and 48 for transmitting a control signal from an exterior, has one end electrically connected to the cavity unit 20, by being bonded to the top surface of the topmost layer of the actuator 30, while the other end is extended in a direction (the X direction) perpendicular to the arrays of the terminals 37. The drive IC chip 49 is mounted on a portion of the flexible wiring material 40 in the extended direction. The drive IC chip 49, based on print data, selectively applies a voltage between the discrete electrodes 33 and the common electrodes 32, and in response to the application of the voltage, as described heretofore, the inks are ejected from the nozzles 25.

Figure 4A:
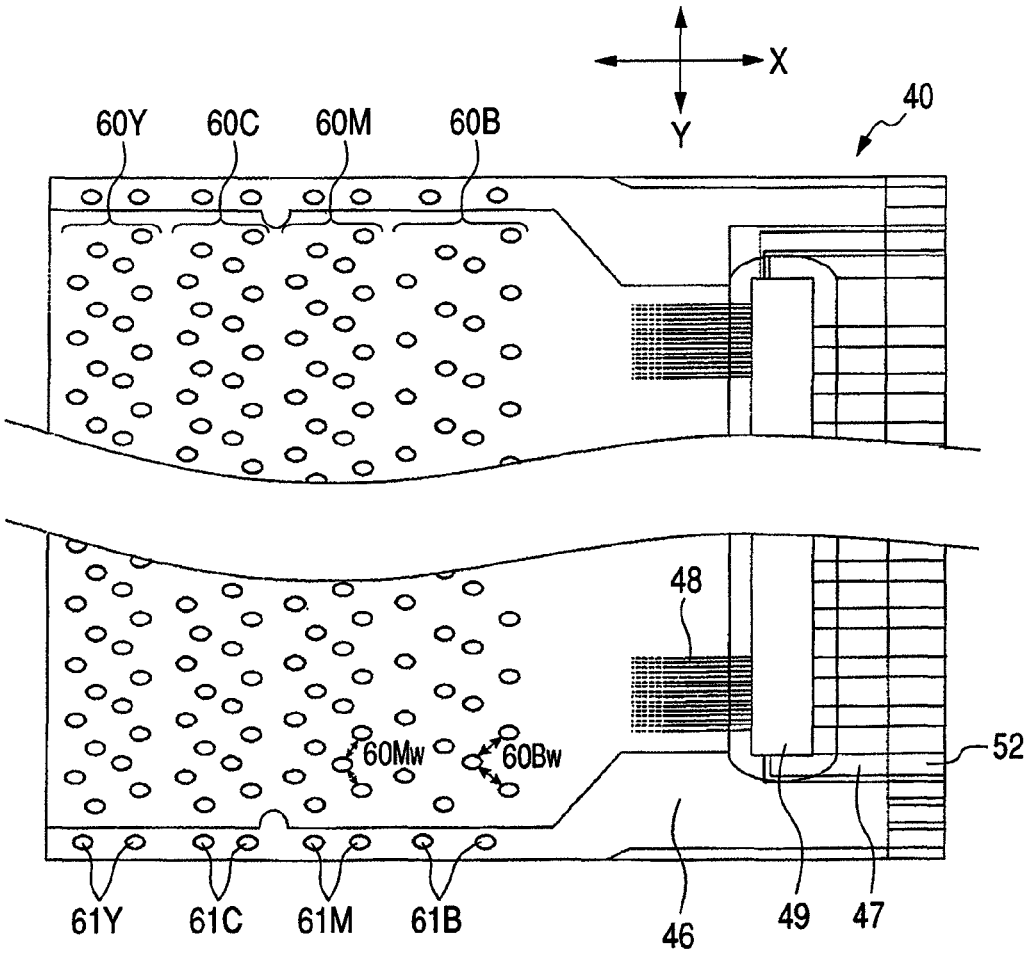
FIG. 4A is a plan view of a bottom surface of a flexible wiring material.
Figure 4B:
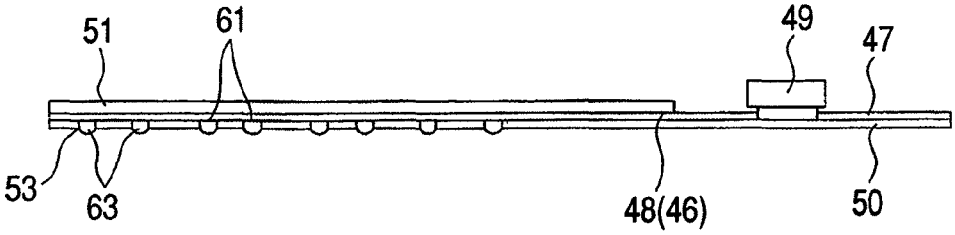
FIG. 4B is a side view of the flexible wiring material.
Figure 6A:
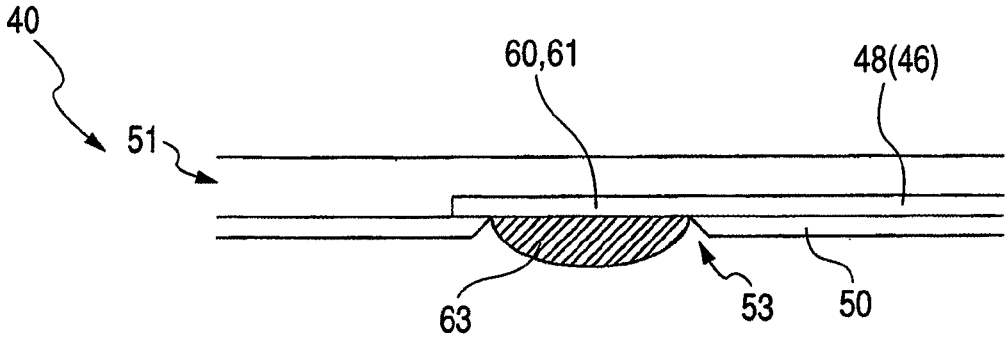
FIGS. 6A and 6B are sectional views showing how a terminal is connected to a bump electrode.
Figure 6B:
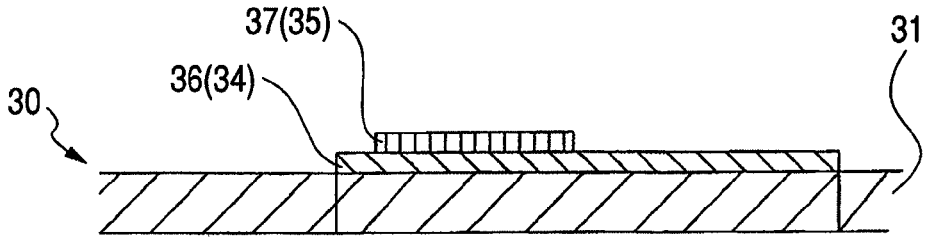

In the flexible wiring material 40, as in FIG. 4B, on one surface of a strip-like base material 50 made of a flexible synthetic resin material with electrical insulation properties (for example, a polyimide resin), the plurality of discrete electrode lands 60 and common electrode lands 61 made of copper foil, to be described hereafter, as well as a plurality of wiring patterns 46, 47 and 48, are formed of a photoresist or the like, and their surfaces are coated with a coverlay 51 made of a flexible synthetic resin material with electrical insulation properties (for example a polyimide resin). Also, the drive IC chip 49 being mounted on a top surface of the base material 50 in the direction (the X direction) in which the flexible wiring material 40 is extended, the wiring patterns 47 are connected to a drive IC chip 49 input side, and the wiring patterns 48 and common electrode leads 46 are connected to an output side. The discrete electrode lands 60 and the common electrode lands 61, being formed in positions corresponding respectively to the discrete electrode terminals 37 and the common electrode terminals 35 are connected to an end of the wiring patterns 48 and the common electrode leads 46. The wiring patterns 47 and the common electrode leads 46 are connected to connection terminals 52 at an outermost end of the flexible wiring material 40 in the extended direction. Furthermore, in the base material 50, holes 53 (openings) are opened in regions corresponding to the island like discrete electrode lands 60 and common electrode lands 61, exposing the lands 60 and 61, and bump electrodes 63 are secured onto the lands 60 and 61 (FIGS. 6A and 6B).

The plurality of island like discrete electrode lands 60 and common electrode lands 61 being formed corresponding to the discrete electrode terminals 37 and the common electrode terminals 35 of the actuator 30, the discrete electrode lands 60, as well as being arranged extending in the Y direction, maintain an interval in the X direction between adjacent arrays, and are arranged in four arrays for each ink color. That is, two adjacent discrete electrode land arrays 60 extending in the Y direction are formed corresponding to two adjacent discrete electrode terminal arrays 37 which, extending in the Y direction, are formed in each discrete terminal array 37 of the actuator 30, and the discrete electrode lands 60 in each array are disposed staggered with respect to each other (60B to 60Y).

Figures 5A, 5B:
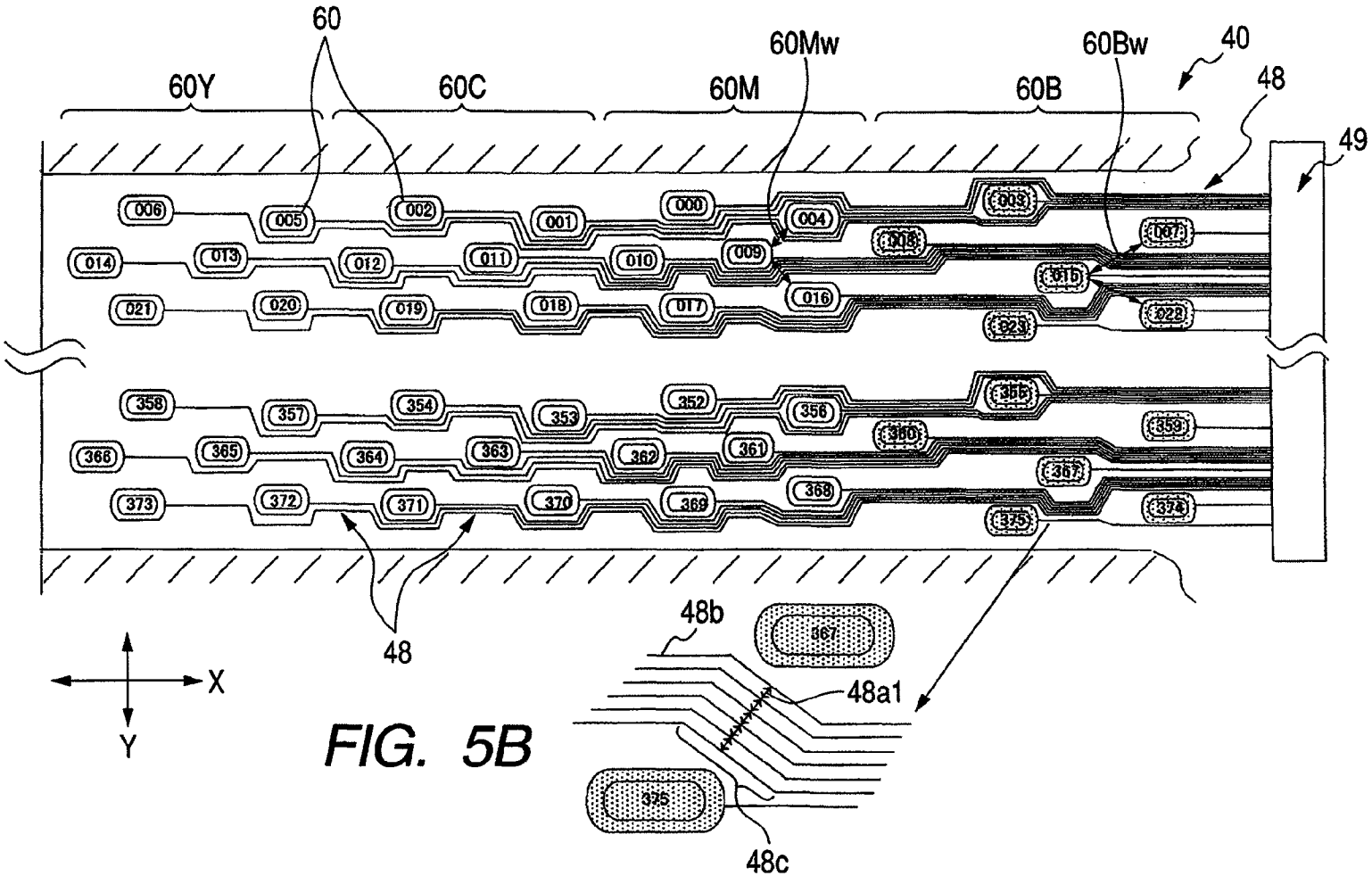
FIG. 5A is a view showing wiring patterns connected from each discrete electrode land.
FIG. 5B is a partial enlarged view of the wiring patterns.

For example, as in FIGS. 5A and 5B, numbers are appended to the discrete electrode lands 60, and when the discrete electrode land array 60B, of the black ink discrete electrode land arrays 60B, disposed on the drive IC chip 49 side is taken as a first array, the discrete electrode lands 60 are arranged, for example, in the first array [007], [022] . . . [359], [374], a second array [015], [030] . . . [367], a third array [003], [023] . . . [355], [375], and a fourth array [008], [031] . . . [360]. Then, in the discrete electrode land arrays 60B adjacent to each other in the Y direction, for example, the discrete electrode lands 60 in the first, second, third and fourth arrays are arranged staggered with respect to each other relative to the Y direction. In the same way, the discrete electrode lands 60 are also arranged in four arrays in each of the other ink discrete electrode land arrays 60M to 60Y, a total of 16 arrays of the discrete electrode lands 60 are arranged at appropriate intervals in the X direction, and the discrete electrode lands 60 in adjacent discrete electrode land arrays are arranged staggered with respect to each other. In FIGS. 5A and 5B, the numbers [000], [001] . . . appended to the discrete electrode lands 60 indicate an order from one end of output terminals of the drive IC chip 49 to which the discrete electrode lands 60 are connected.

As in FIGS. 4A, 4B, 5A and 5B, a distance between two discrete electrode lands 60 adjacent to each other in the Y direction in two adjacent discrete electrode land arrays 60 (a distance between lands 60 adjacent to each other in the Y direction in adjacent odd number and even number arrays) corresponds to a distance between the discrete electrode terminals 45, and a distance 60Bw between adjacent lands 60 in the black ink discrete electrode land arrays 60B (for example, a distance between [007] and [015], and between [015] and [022]) is greater than a distance 60Mw between adjacent lands in the other ink discrete electrode land arrays 60 (for example, a distance between [004] and [009], and between [009] and [016] in the magenta ink discrete electrode land arrays 60M). The cyan ink discrete electrode land arrays 60C and the yellow ink discrete electrode land arrays 60Y are also similar to the magenta ink ones.

Also, each of the plurality of discrete electrode lands 60 is connected to the wiring pattern 48, and the wiring patterns 48, passing through spaces between the plurality of discrete electrode lands 60, extend in the X direction spaced an appropriate distance apart from one another, and are connected to the drive IC chip 49. The wiring patterns 48 are each formed of an approximately linear portion 48*b* approximately parallel to the X direction and a bend portion 48*c* extending at an angle to the X direction between two adjacent discrete lands 60. A distance between the wiring patterns is determined by a number of wiring patterns and a distance between the discrete electrode land arrays 60. For this reason, the closer to a side of the wiring patterns 48 in a direction in which they are led out in a largest amount (a side on which the wiring patterns are integrated into the drive IC chip 49), the narrower and finer they are. That is, a distance is smallest and finest between the bend portions 48*c* of the wiring patterns 48, which pass between the discrete electrode lands 60 adjacent to each other in the Y direction in the first array [007] and the second array [015], among adjacent black ink discrete electrode land arrays 60B, which are closest to the drive IC chip 49.

In the invention, as the distance 60Bw between the black ink discrete electrode lands 60, among the distances between the discrete electrode lands 60 through which the wiring patterns 48 pass, into which the wiring patterns 48 are most highly integrated is greater than the other places, the bend portions 48*c* of the wiring patterns 48 can be wired at wiring pattern intervals 48*a*1 which are not so fine.

Also, the common electrode lands 61 are formed arranged, two for each ink color (61B to 61Y) in the X direction, on the common electrode leads 46 which, extending in the X direction from the drive IC chip 49, are formed along the perimeter at both ends of the flexible wiring material 40. The common electrode leads 46 are formed in a strip shape in such a way as to be aligned in approximate parallel with the corresponding common surface electrodes 34 of the actuator 30.

The bump electrodes 63 provided on the discrete electrode lands 60 and the common electrode lands 61 are attached thereto by melting a conductive brazing material such as a solder. Then, the bump electrodes 63 on the discrete electrode lands 60 and the common electrode lands 61 of the flexible wiring material 40 are superimposed on the corresponding discrete electrode terminals 37 and common electrode terminals 35 of the actuator 30, and by being heated and pressed, are melted, providing an electrical and mechanical connection between the corresponding lands 60, 61 and terminals 37, 35.

In this exemplary aspect, pigment ink is used for the black ink, and dye ink is used for the color inks. For this reason, when a recording medium is printed by ejecting each ink, the black ink is less likely to spread with respect to paper and, in the event that both types of ink are made so as to have the same ink droplet volume, a printing quality is affected in such a way that a dot diameter of one droplet of the black ink becomes smaller than that of the color inks. However, as a nozzle diameter 25Bw which ejects the black ink is larger than the other nozzle diameters, also, the pressure chambers 23B in the cavity unit 20 which supply the black ink are larger than the other pressure chambers 23M to 23Y, and furthermore, the corresponding energy generators are also made larger, an energy for causing the ejection of the black ink is large, enabling the black ink droplets to be made largest in volume of all ink droplets ejected in one operation. By this means, the color inks and the black ink are made approximately uniform in a dot diameter on the recording medium, enabling an improvement in the printing quality. Also, as the volume of the black ink is larger than that of the color inks, even in the event that the black ink and the color inks are both made from the same type of pigment ink or dye ink, and have the same spread on the recording medium, it is possible to guarantee that a dot diameter of the color inks is prevented from becoming larger than a dot diameter of a monochromatic black ink due to an overlap of a plurality of the color inks.

Also, in this exemplary aspect, energy generator arrays are formed for each ink color, along with which the discrete electrode land arrays 60 are formed for each ink color, and the distance between two adjacent lands in the black ink discrete electrode land arrays 60B is formed to be wide. However, there is no particular need for a separation for each ink color, and it is sufficient that a distance is wide between two discrete electrode lands adjacent to each other in the Y direction in two discrete electrode land arrays 20 on the side on which the wiring patterns 48 are integrated into the drive IC chip 49.

What is claimed is:

1. An ink jet recording head comprising:

an actuator including:

a plurality of energy generators, for ejecting ink; and a plurality of terminals arranged in a plurality of arrays on a surface of the actuator, for applying a voltage to each of the energy generators, each of the arrays extending in an array direction;

a wiring material superimposed on the surface of the actuator, and including a plurality of lands which are arranged in a plurality of arrays corresponding to the plurality of terminals, respectively; and a plurality of wiring patterns which are connected to the plurality of lands respectively and which are led out toward a led out side in a lead out direction parallel to the surface of the actuator and perpendicular to the array direction of the arrays of the terminals;

wherein the lands are electrically connected to the terminals, respectively;

wherein lands of the plurality of lands in adjacent arrays are arranged staggered with respect to each other;

wherein a distance between at least two adjacent land arrays provided closest to the led out side among the arrays of the plurality of lands is greater than a distance between adjacent ones of the other arrays of lands; and wherein the wiring pattern has a bend portion, which extended at an angle to the led out direction, at a position between two adjacent discrete lands in the at least two adjacent land arrays.

2. The ink jet recording head according to claim 1;

wherein the energy generators are formed in arrays for each of a plurality of color inks;

wherein the terminals are formed in a plurality of arrays for each of the plurality of color inks, and terminals in adjacent arrays are arranged staggered with respect to each other; and wherein the lands are formed in a plurality of arrays for each of the plurality of color inks corresponding to the terminals, and lands in adjacent arrays are arranged staggered with respect to each other.

3. The ink jet recording head according to claim 1, further comprising:

a plurality of pressure chambers which contains the ink corresponding to the individual energy generators;

wherein pressure chambers, among the plurality of pressure chambers, which correspond to the terminals on the lead out side include a longer length in the led out direction than the other pressure chambers; and wherein energy generators corresponding to the longer pressure chambers include a longer length in the led out direction than energy generators corresponding to the other pressure chambers.

4. The ink jet recording head according to claim 3;

wherein an ink contained in the longer pressure chambers is a black ink; and wherein inks contained in the other pressure chambers are color inks.

5. The ink jet recording head according to claim 1;

wherein terminals corresponding to one array of the energy generators on the lead out side, and adjacent to each other in the array direction, are positioned staggered with respect to each other in the led out direction.

6. The ink jet recording head according to claim 5;

wherein one array of surface electrodes is formed on the surface of the actuator corresponding to the one array of the energy generators on the lead out side, and each of the surface electrodes includes a prescribed length in the led out direction; and wherein the terminals are formed to have one terminal on each of the surface electrodes, and terminals on adjacent surface electrodes are positioned staggered with respect to each other in the led out direction.

7. The ink jet recording head according to claim 1;

wherein the plurality of lands includes a plurality of bump electrodes provided thereon, and the plurality of bump electrodes and the plurality of terminals are correlated and bonded.

8. The ink jet recording head according to claim 1;

wherein terminals of the plurality of terminals in adjacent arrays are arranged staggered with respect to each other; and wherein a distance between at least two adjacent terminal arrays, among the arrays of the plurality of terminals, on the led out side at which the wiring patterns are led out is greater than a distance between adjacent ones of the other arrays of terminals.

9. An ink jet recording head comprising:

an actuator including:

a plurality of energy generators, for ejecting ink; and a plurality of terminals arranged in a plurality of arrays on a surface of the actuator, for applying a voltage to each of the energy generators, each of the arrays extending in an array direction;

a wiring material superimposed on the surface of the actuator, and including a plurality of lands which are arranged in a plurality of arrays corresponding to the plurality of terminals, respectively; and a plurality of wiring patterns which are connected to the plurality of lands respectively and which are led out toward a led out side in a lead out direction parallel to the surface of the actuator and perpendicular to the array direction of the arrays of the terminals;

wherein the lands are electrically connected to the terminals, respectively;

wherein lands of the plurality of lands in adjacent arrays are arranged staggered with respect to each other;

wherein a distance between two adjacent land arrays provided closest to the led out side among the arrays of the plurality of lands is greater than a distance between adjacent land arrays provided farthest from the led out side among the arrays of the plurality of lands; and wherein the wiring pattern has a bend portion, which extended at an angle to the led out direction, at a position between two adjacent discrete lands in the at least two adjacent land arrays.

* * * * *